US006678929B2

(12) United States Patent
Korytkowski et al.

(10) Patent No.: US 6,678,929 B2
(45) Date of Patent: Jan. 20, 2004

(54) SPIRAL SHEAR GEAR BURNISHING DIES

(75) Inventors: Zdzislaw W. Korytkowski, Park Ridge, IL (US); Charles H. Moody, Chicago, IL (US); James H. Pospisil, Alexandria, MN (US); Gary L. Storm, Fergus Falls, MN (US)

(73) Assignee: Illinois Tool Works Inc., Glenview, IL (US)

( * ) Notice: Subject to any disclaimer, the term of this patent is extended or adjusted under 35 U.S.C. 154(b) by 74 days.

(21) Appl. No.: 09/941,465

(22) Filed: Aug. 29, 2001

(65) Prior Publication Data

US 2003/0041429 A1 Mar. 6, 2003

(51) Int. Cl.[7] ..... B24B 39/00
(52) U.S. Cl. ..... 29/90.6; 72/102
(58) Field of Search ..... 29/90.6; 72/102

(56) References Cited

U.S. PATENT DOCUMENTS

| | | | |
|---|---|---|---|
| 1,990,239 | A | 2/1935 | Miller |
| 2,137,146 | A | 11/1938 | Simmons |
| 2,208,959 | A | 7/1940 | Cain |
| 2,228,965 | A | 1/1941 | Miller |
| 2,228,966 | A | 1/1941 | Miller |
| 2,374,784 | A | 5/1945 | Simpson |
| 3,321,820 | A | 5/1967 | Rosendahl |
| 3,611,772 | A | 10/1971 | Haug |
| 3,709,015 | A | 1/1973 | Loos |
| 3,813,821 | A | 6/1974 | Takahashi et al. |
| 4,067,218 | A | 1/1978 | Bibbens |
| 4,305,190 | A | 12/1981 | Flair |
| 4,414,780 | A | 11/1983 | Jorgensen |

OTHER PUBLICATIONS

Abstract of Soviet patent SU 908559 B to Badamshin et al. published Feb. 28, 1982.*

* cited by examiner

*Primary Examiner*—I Cuda Rosenbaum
(74) *Attorney, Agent, or Firm*—Donald J. Breh; Mark W. Croll; Lisa M. Soltis

(57) ABSTRACT

A burnishing gear or burnishing die has a plurality of spiral gashes formed within each one of the burnishing gear teeth at a predetermined angle with respect to a transverse plane so as to define shearing edges along side involute portions of the burnishing gear teeth. The shearing edges enable enhanced finishing or burnishing operations to be performed upon workpiece gears in order to effectively remove positive imperfections, irregularities, nicks, or the like from the workpiece gear teeth so as to finish the workpiece gear in accordance with desired tolerances. The burnishing gear may be incorporated within burnishing gear systems utilizing burnishing gears characterized by different operating pressure angles as well as within burnishing gear systems that have mechanisms for reciprocating the workpiece gear during a gear burnishing operation.

21 Claims, 4 Drawing Sheets

SPIRAL SHEAR GEAR BURNISHING DIES

FIELD OF THE INVENTION

The present invention relates generally to gear burnishing dies or burnishing gears, and more particularly to a new and improved gear burnishing die or burnishing gear, as well as systems or apparatus having such dies or gears incorporated therein, wherein the burnishing die or burnishing gear is provided with a plurality of spiral gashes that are especially and uniquely adapted to burnish or remove irregularities from the involutes or side surface portions of the gear teeth by, in effect, shearing nicks, burrs, and other positive or protruding material masses which may appear or be present upon the involutes or sides of the gear teeth as a result of the original processing or manufacture of the same.

BACKGROUND OF THE INVENTION

Gear burnishing dies comprise in effect gear type apparatus which burnish or process gears in order to remove irregularities which may be present upon the gear surfaces as a result of the original processing or manufacture of the same. A basic gear burnishing system was originally disclosed, for example, within U.S. Pat. No. 3,321,820 which issued to Guenter K. Rosendahl on May 30, 1967 and comprised the use of three burnishing gears which effectively cooperated together in unison so as to remove irregularities which were present upon the gear tooth surfaces of a single workpiece gear. While such a gear burnishing system obviously constituted an appreciable improvement in connection with the processing of gears in view of the fact that such a system reduced the irregularities appearing or present upon the gear tooth surfaces of the workpiece gear, such a system was nevertheless not entirely satisfactory. More particularly, it was recognized that despite the use of the three burnishing gears which were arranged within a substantially triangular array so as to effectively simultaneously work together upon circumferentially spaced tooth regions of the single workpiece gear during a work cycle comprising multiple gear revolutions, such a system was not always able to process gears to a predeterminedly required degree of gear accuracy and suitability. In particular, it was found that the tips of the gear teeth were still exhibited nicks and burrs, and not all areas of each gear tooth flank were able to be uniformly burnished. It was further determined that these operational defects or drawbacks characteristic of the Rosendahl system resided in or were based upon the fact that all three of the burnishing gears employed substantially equal operating pressure angles.

Accordingly, substantial improvements upon the system disclosed within the Rosendahl patent were subsequently made by means of the gear burnishing system disclosed, for example, within U.S. Pat. No. 4,305,190 which issued to Henry J. Flair on Dec. 15, 1981. Briefly, in accordance with the improved system of Flair, which is schematically illustrated in FIG. 1 which corresponds to FIG. 2 of the noted patent, and wherein the entire disclosure of such patent is hereby incorporated by reference, it is seen that the burnishing gears are respectively disclosed at 12, 32, and 40 in a substantially triangular array, a workpiece gear to be processed and burnished is disclosed at 1, and a workpiece gear that has already been processed and burnished is disclosed at 1*a*. The workpiece gear 1 to be processed is delivered to the central processing or burnishing position between the three burnishing gears 12, 32, 40 by means of a delivery or feed chute 10, and the workpiece gear 1*a* which has already been processed and burnished is removed from the central processing or burnishing position by means of an exit chute 50. In accordance with the teachings of such patented system, all three of the burnishing gears 12, 32, 40 have different operating pressure angles, and consequently, as a result of the provision of such a tri-variable operating pressure angle gear system, the surface-to-surface contact defined between the workpiece gear 1 and the burnishing gears 12, 32, 40 results in the fact that virtually all regions of the gear teeth flanks, as well as the gear teeth tip portions of the workpiece gear 1, are able to be addressed and processed.

In order to process or burnish workpiece gears upon which relatively large irregularities or nicks are present, and in connection with which such workpiece gears could not properly be processed or burnished by means of the noted patented system of Flair, additional improvements to the system of Flair were needed. Accordingly, such improvements were in effect developed and are disclosed, for example, within U.S. Pat. No. 4,414,780 which issued to Arne R. Jorgensen on Nov. 15, 1983. In accordance with this last-mentioned patent, which is disclosed within FIG. 2 which corresponds to FIG. 1 of the noted patent, and wherein the entire patent of Jorgensen is hereby incorporated by reference, the workpiece gear 12 is axially oscillated or reciprocated, in conjunction with controlled rotary motion of the burnishing gears 16, 18, 20, so as to achieve more uniform sliding action. In a manner similar to that of the system of Flair, the workpiece gear 12 is adapted to be delivered to the processing or burnishing position between the three burnishing gears 16, 18, 20 by means of a delivery or input chute 14, and the processed or burnished gear 12 is adapted to be removed from the processing or burnishing position between the burnishing gears 16, 18, 20 by means of an exit or output chute 46.

The implementation or incorporation of such reciprocating or oscillating components, however, into the gear burnishing system obviously renders the overall system more expensive to implement. In addition, the patented system of Jorgensen also presents an operational drawback in that the reciprocating or oscillating action imparted to the workpiece gear results in the generation of a significant amount of heat. Accordingly, the use of coolant during the processing or burnishing of the workpiece gears is required, however, the required use of coolant presents additional operational problems. For example, it is expensive to incorporate a coolant dispensing system into the overall workpiece gear burnishing system, and in addition, the processed or burnished gears need to be subsequently washed, cleansed, or rinsed in order to remove any coolant which may be residually present upon the processed or burnished work-piece gears. Still yet further, it has been noted or experienced that, even with the incorporation of the oscillating or reciprocating mechanism into the system disclosed within Jorgensen in order to process or burnish workpiece gears upon which relatively large irregularities or nicks are present, such a system cannot in fact burnish or process the largest or most broadbase irregularities, nicks, or the like which nevertheless should or could be able to be processed or burnished in order to permit such workpiece gears to still meet predeterminedly required degrees of gear accuracy and suitability.

A need therefore exists in the art for a new and improved gear burnishing die or burnishing gear which can effectively be incorporated either within the apparatus or system of Flair, or alternatively, within the apparatus or system of Jorgensen, wherein the new and improved gear burnishing die or burnishing gear is more effective than prior art gear burnishing dies or burnishing gears such that, except for the largest irregularities, nicks, burrs, or the like, when such new and improved gear burnishing dies or burnishing gears are incorporated, for example, within the system of Flair, relatively large irregularities, nicks, burrs, or the like, can be effectively removed in accordance with dry processing or burnishing techniques whereby the use of coolant, and the expense of incorporating such coolant systems into the overall gear burnishing system, is obviated, and wherein further, the new and improved gear burnishing die or burnishing gear is more effective than prior art gear burnishing dies or burnishing gears such that, when such new and improved gear burnishing dies or burnishing gears are incorporated, for example, within the system of Jorgensen whereby the workpiece gear oscillating or reciprocating system is in fact to be utilized, the largest or broadbase irregularities, nicks, burrs, or the like, can in fact be effectively removed.

OBJECTS OF THE INVENTION

Accordingly, it is an object of the present invention to provide a new and improved gear burnishing die or burnishing gear, and a system or apparatus having such a burnishing gear or die incorporated therein.

Another object of the present invention is to provide a new and improved gear burnishing die or burnishing gear, and a system or apparatus having such a burnishing die or gear incorporated therein, which overcomes the various drawbacks and disadvantages of PRIOR ART gear burnishing die or burnishing gear and the systems having such dies or gears incorporated therein.

An additional object of the present invention is to provide a new and improved gear burnishing die or burnishing gear, and a system or apparatus having such a burnishing die or gear incorporated therein, which overcomes the various drawbacks and disadvantages of PRIOR ART gear burnishing die or burnishing gear and the systems having such dies or gears incorporated therein by being capable of burnishing gear members in accordance with a shearing action.

A further object of the present invention is to provide a new and improved gear burnishing die or burnishing gear, and a system or apparatus having such a burnishing die or gear incorporated therein, which overcomes the various drawbacks and disadvantages of PRIOR ART gear burnishing die or burnishing gear and the systems having such dies or gears incorporated therein by being capable of burnishing gear members in accordance with a shearing action whereby gear burnishing operations, which previously required the use of coolant-applied oscillating or reciprocating mechanisms, can now be accomplished by means of coolant-free gear burnishing systems.

A last object of the present invention is to provide a new and improved gear burnishing die or burnishing gear, and a system or apparatus having such a burnishing die or gear incorporated therein, which overcomes the various drawbacks and disadvantages of PRIOR ART gear burnishing die or burnishing gear and the systems having such dies or gears incorporated therein by being capable of burnishing gear members in accordance with a shearing action whereby gear burnishing operations, which previously required the use of coolant-applied oscillating or reciprocating mechanisms, can now be accomplished by means of coolant-free gear burnishing systems, or alternatively, when the burnishing gears or dies of the present invention are incorporated within an oscillating or reciprocating gear burnishing system, the largest or most broadbase nicks or irregularities are able to be burnished and properly finished to required tolerances.

SUMMARY OF THE INVENTION

The foregoing and other objectives are achieved in accordance with the teachings and principles of the present invention through the provision of a new and improved gear burnishing die or burnishing gear, and a system or apparatus having such a gear burnishing die or burnishing gear incorporated therein, which comprises the provision of a plurality of spiral slashes or gashes formed within the gear teeth of the burnishing gear or gear burnishing die. The slashes or gashes may be on the order to 0.050 inches in width, they are designed to extend from the root portion of each tooth to the crest portion of each tooth, and are disposed at an angle of between 45°–60° with respect to a transverse plane across each tooth. As a result of the provision of such gashes or slashes within the burnishing gear or burnishing die, positive imperfections, nicks, irregularities, or the like, are effectively removed by means of a shearing action as the workpiece gear is slidably or rollably moved across or relative to the burnishing gear or burnishing die, and the removed positive material is caught within the space or slot defined upon the burnishing gear or burnishing die by means of the slash or gash formed therein and is accordingly removed thereby. Still further, such burnishing gears or burnishing dies may be operatively incorporated within systems such as those disclosed within the aforenoted Jorgensen and Flair patents, wherein, in connection with those systems, the new and improved burnishing gears or burnishing dies developed in accordance with the principles and teachings of the present invention may in effect be substituted for the low operating pressure angle and high operating pressure angle burnishing gears or burnishing dies 40 and 32, respectively, of Flair, and 20 and 18, respectively of Jorgensen, such that improved burnishing operations can in fact be performed upon workpiece gears whereby enhanced burnishing results can be attained.

It is noted in conjunction with the aforenoted low and high operating pressure angle burnishing gears or burnishing dies that the gash or slash structure developed in accordance with the teachings and principles of the present invention need not necessarily be incorporated within the remaining third burnishing gear or burnishing die as seen at 12 in the Flair patented system and at 16 in the Jorgensen patented system. The reason for this is that such burnishing gears or burnishing dies 12, 16, respectively, are used for burnishing the tip portions of the workpiece gears wherein the burnishing operations or finishes performed with respect to such tip portions of the workpiece gears are substantially or primarily achieved through means of a hammering effect as a result of contact between the burnishing gear or burnishing die and the workpiece tip portion as opposed to a sliding or rubbing effect or action as defined between the burnishing gear or burnishing die and the involute side portions of the workpiece gear as achieved by means of the burnishing gears or burnishing dies 40, 32 of Flair or the burnishing gears or burnishing dies 20, 18 of Jorgensen.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
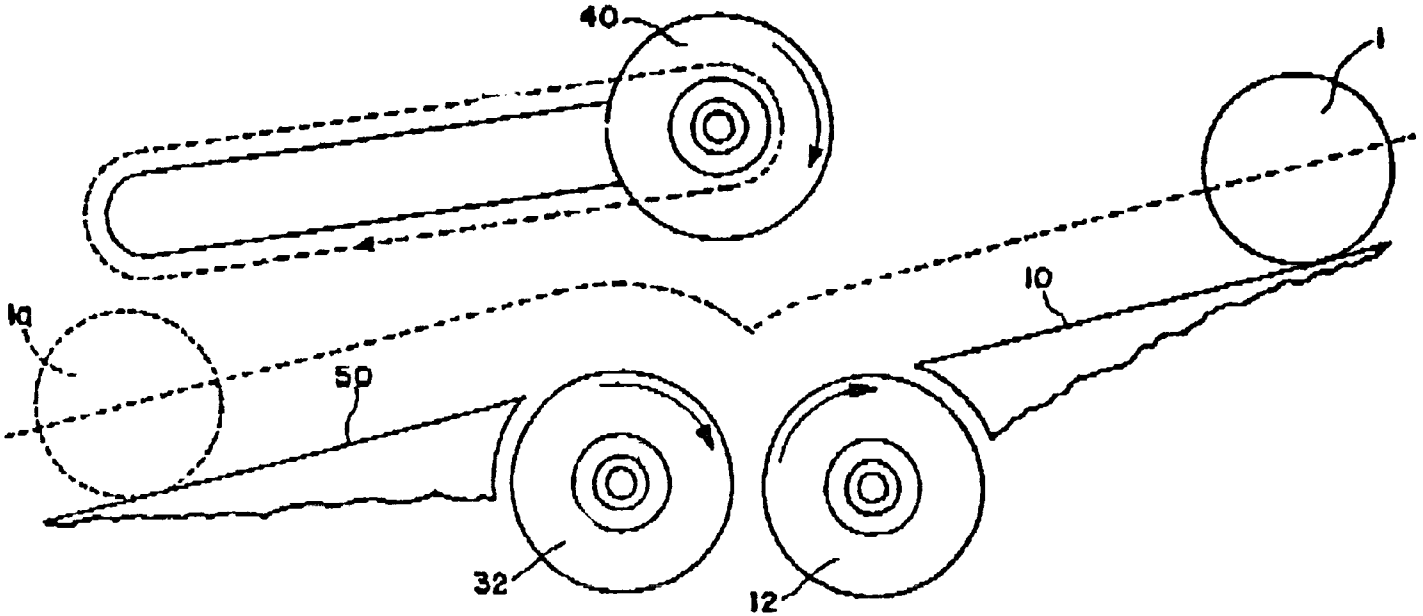
FIGURE 1 (PRIOR ART)
FIG. 1 is a schematic front elevational view of a first PRIOR ART gear burnishing system as disclosed, for example, within U.S. Pat. No. 4,305,1990.
Figure 2:
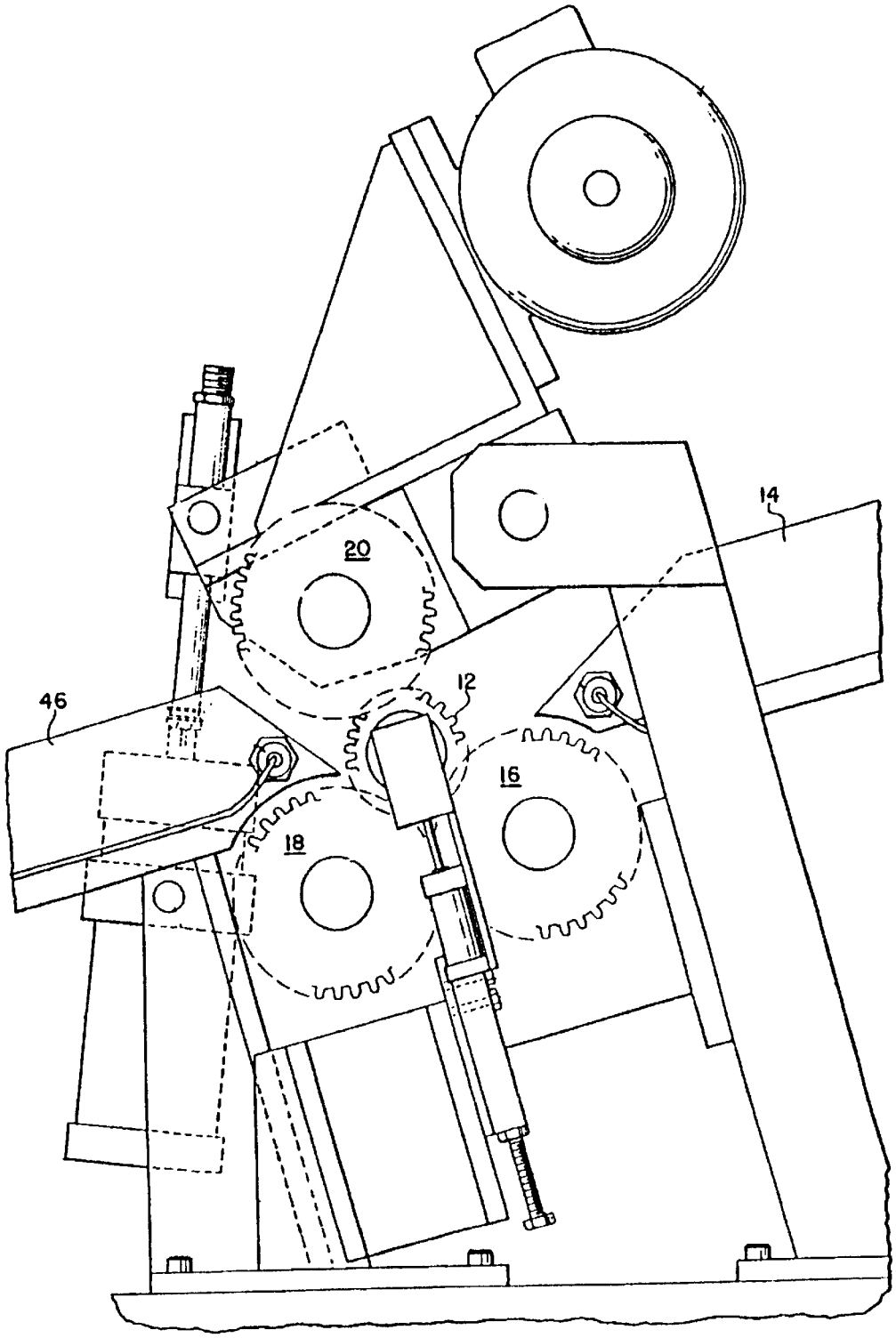
FIGURE 2 (PRIOR ART)
FIG. 2 is a front elevational view of a second PRIOR ART gear burnishing system as disclosed, for example, within U.S. Pat. No. 4,414,780.
Figure 3:
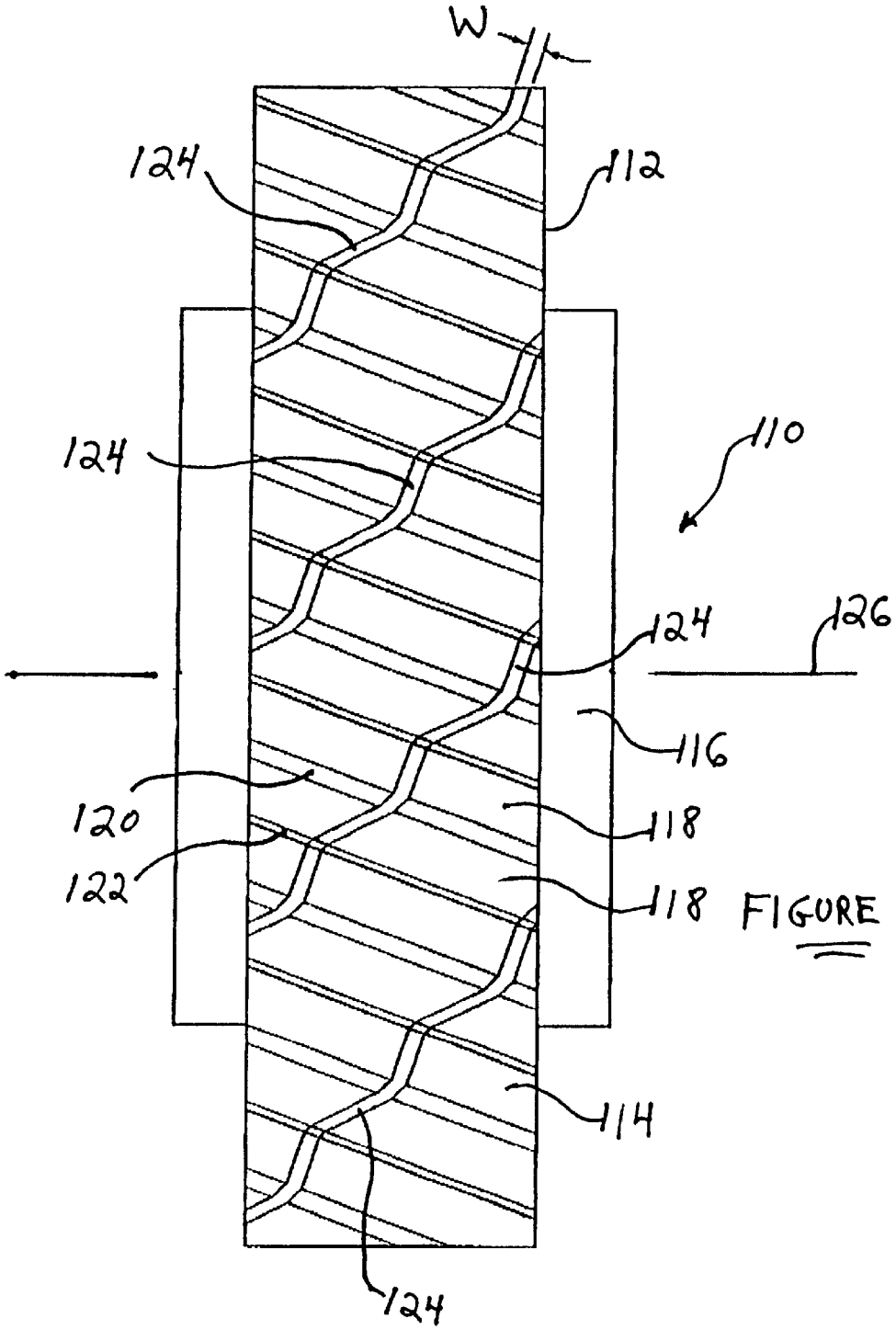
FIG. 3 is a top plan view of a new and improved burnishing gear or burnishing die constructed in accordance with the principles and teachings of the present invention and showing the operative parts thereof including the provision of the spiral gashes across the burnishing gear teeth.

Referring now to the drawings, and more particularly to FIG. 3 thereof, a new and improved burnishing die or burnishing gear assembly, constructed in accordance with the principles and teachings of the present invention, is disclosed and is generally indicated by the reference character 110. More particularly, the burnishing gear or burnishing die assembly 110 is seen to comprise a burnishing gear or burnishing die 112 as defined by means of a plurality of circumferentially arranged, angularly spaced teeth 114, and it is seen that the burnishing gear or burnishing die 112 is integrally mounted or formed upon a burnishing gear or burnishing die hub portion 116. Each gear tooth 114 of the burnishing gear or burnishing die 112 is seen to comprise side involute portions 118, a crest portion 120, and a root portion 122, and in accordance with the particularly unique and novel structure developed in accordance with the principles and teachings of the present invention, the burnishing gear or burnishing die 112 is provided with a plurality of spiral gashes or cuts 124 which are formed through the entire lateral or substantially circumferential extent of each tooth 114 such that resulting spaces, slots, or gaps defined by such gashes or cuts 124 extend across each root portion 122, each side involute portion 118, and each crest portion 120 of each burnishing gear or burnishing die tooth 114 and thereby effectively separate each burnishing gear or burnishing die tooth 114 into longitudinally spaced tooth sections as considered along the longitudinal extent of each tooth which extends from one axial side of the burnishing gear or burnishing die 112 to the opposite axial side of the burnishing die or burnishing gear 12. The width W of each gash, slot, or space 124 is approximately 0.050 inches, and the pitch, or distance defined between successive or adjacent gashes or slots 124 as considered in the peripheral or circumferential direction around the rotary axis 126 of the burnishing gear or burnishing die 112, is approximately 1.00 inch. Obviously, depending upon the diametrical size of the particular burnishing die or burnishing gear 112, the number of gashes or slots 124 as defined in effect upon the peripheral or circumferential surface of such burnishing gear or burnishing die 112 will vary, that is, relatively larger burnishing gears or burnishing dies 112 will have a larger number of gashes or slots 124 formed thereon than upon relatively smaller burnishing gears or burnishing dies 112.

Figure 4:
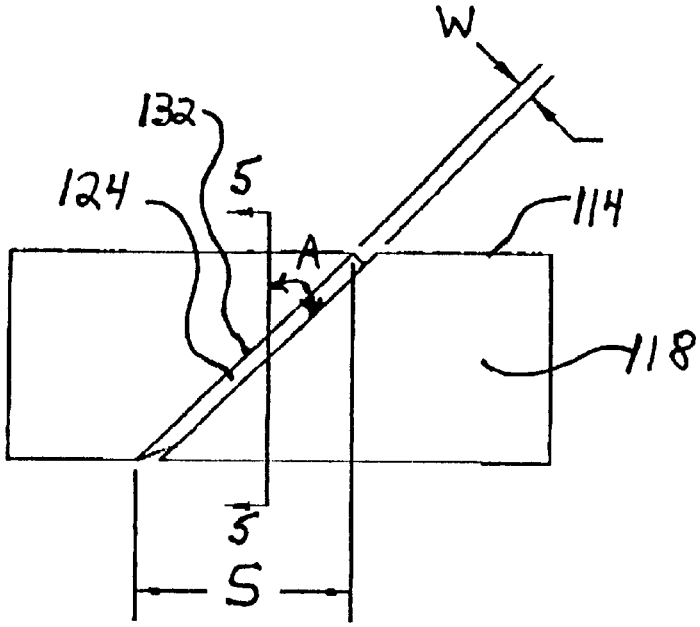
FIG. 4 is a side elevational view of a side involute portion of a gear tooth disposed upon the burnishing gear or burnishing die as shown in FIG. 3.
Figure 5:
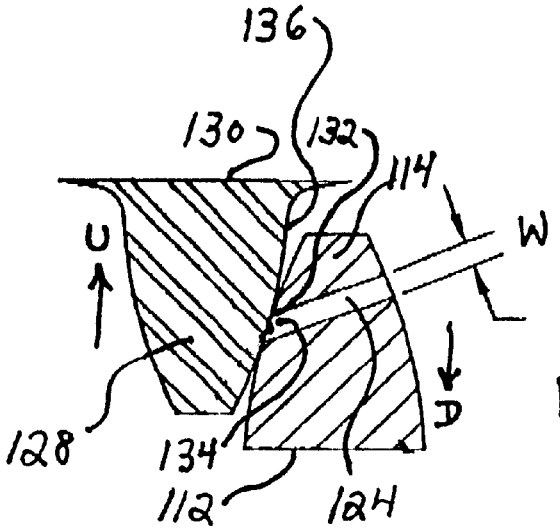
FIG. 5 is a cross-sectional view of the gear tooth shown in FIG. 4 as taken along the lines 5—5 of FIG. 4 and shown in operative conjunction with a workpiece gear tooth to be burnished.

With reference being additionally made to FIG. 4, it is further seen that, looking at the side involute portion 118 of a particular burnishing gear or burnishing die tooth 114 from an elevational point of view, each helical or spiral gash or slot 124 is sliced or cut through each burnishing gear or burnishing die tooth 114 so as to be disposed at a predetermined angle A, with respect to a plane which is positioned transversely with respect to the gear or die tooth 114, which may be within a range of 45°–60°. Accordingly, as can be appreciated from FIG. 4, each spiral gash or cut 124 serves to effectively define a shear area S along the longitudinal extent of each gear or die tooth 114. Consequently, as may be further appreciated if reference is additionally made to FIG. 5, when each burnishing die or burnishing gear tooth 114 of the burnishing gear or burnishing die 112 is rotated during the performance of a burnishing operation with respect to a gear tooth 128 of a workpiece gear 130, wherein the burnishing gear or burnishing die tooth 114 will be moving in a relatively downward direction D with respect to the gear tooth 128 of the workpiece gear 130 which will be moving in a relatively upward direction U, what may be considered to be in effect the upper lateral edge portion 132 of the burnishing gear or burnishing die tooth 14 serves as a shearing edge so as to shear off any positive imperfections, nicks, irregularities, or the like 134 which may be present upon the side involute portion 136 of the workpiece gear tooth 128. The sheared-off or removed imperfection, nick, or irregularity 134 will fall or drop into the space or slot defined by means of the spiral gash or cut 124, and the side involute portion 136 of the workpiece gear tooth 128 will therefore have been properly or suitably burnished and finished.

Continuing further, it is to be additionally appreciated that the new and improved burnishing gear or burnishing die 110, having the aforenoted unique and novel structure integrally formed thereon, could be operationally incorporated within a system such as that disclosed within the patent to Flair whereby the new and improved burnishing gear or burnishing die 110 would in effect be operationally substituted for each one of the high and low operating pressure angle burnishing gears or burnishing dies 32 and 40, respectively. As a result of the incorporation of such new and improved burnishing gear or burnishing die 110 into the burnishing gear or burnishing die system of Flair, larger or more broadbase imperfections, irregularities, nicks, or the like, can be effectively removed from workpiece gears, such as workpiece gears 1, 1*a* as shown in Flair, than would otherwise ordinarily or normally be possible with a system such as that of Flair if the new and improved burnishing gear or burnishing die 110 of the present invention was not in fact incorporated within such a system. More particularly, larger or more broadbase imperfections, irregularities, nicks, or the like, which could only otherwise ordinarily or normally be effectively removed from workpiece gears by burnishing the same within a coolant-applied reciprocating system such as that shown in the patented system of Jorgensen, can now be effectively burnished to desired tolerances by incorporating the burnishing gear or burnishing die 110 of the present invention into the system of Flair whereby the adverse operational drawbacks of operating a coolant-applied reciprocating system, such as that shown in Jorgensen, can be obviated.

Of course, proceeding further, in those instances wherein workpiece gears, having the largest or most broadbase imperfections, irregularities, nicks, or the like, disposed or formed thereon and which are desired to be removed, are to be burnished whereby such workpiece gears can be properly finished to desired tolerances, the new and improved burnishing gear or burnishing die 110 of the present invention may in fact likewise be incorporated within a coolant-applied reciprocating workpiece gear burnishing system such as that disclosed within the aforenoted Jorgensen patent. More particularly, as was the case with the incorporation of such new and improved burnishing gear or burnishing die 110 of the present invention into the patented system of Flair, the new and improved burnishing gear or burnishing die 110 can effectively be operationally substituted for each one of the high and low operating pressure angle burnishing gears or burnishing dies 18 and 20, respectively, of the patented system of Jorgensen. Consequently, despite the aforenoted operational and economic drawbacks characteristic of a coolant-applied burnishing gear system such as that of Jorgensen, as a result of the operational incorporation of the new and improved burnishing gear or burnishing die 110, developed in accordance with the principles and teachings of the present invention, into a coolant-applied gear burnishing system such as that of Jorgensen, it is possible to burnish workpiece gears having the largest or most broadbase imperfections, irregularities, nicks, or the like, formed thereon whereby such workpiece gears are now able to be suitably finished to desired tolerances.

Thus, it may be seen that in accordance with the principles and teachings of the present invention, a new and improved burnishing gear or burnishing die has been developed wherein, during a burnishing or finishing operation, the new and improved burnishing gear or burnishing die effectively removes positive irregularities, imperfections, nicks, or the like, by means of a shearing action. This shearing action is achieved by the provision of spiral gashes within and across the gear teeth of the burnishing gear or burnishing die whereby angled shearing edges are effectively defined upon side involute portions of the burnishing gear or die. As a result of such gash and shearing edge structure, enhanced burnishing and finishing tolerances are able to be achieved.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A burnishing gear assembly, comprising:

a hub portion defined around an axis;

a burnishing gear being integrally formed upon said hub portion, having first and second axially separated sides, and having a plurality of burnishing gear teeth, having root and crest portions, extending substantially radially outwardly from said hub portion and circumferentially spaced with respect to each other around said axis; and a plurality of gashes, circumferentially spaced with respect to each other and respectively extending between said first and second axially separated sides in a non-circumferential manner, such that each one of said burnishing gear teeth of said burnishing gear has at least one gash formed therein so as to extend substantially across the entire lateral extent of said each one of said burnishing gear teeth, as well as substantially from said root portion to said crest portion of said each one of said burnishing gear teeth, so as to define at least one shearing edge portion upon said each one of said burnishing gear teeth for removing irregularities from a workpiece gear when said burnishing gear is operatively engaged with the workpiece gear during a gear burnishing operation.

2. A burnishing gear system, comprising:

a trio of burnishing gear assemblies arranged substantially within a triangular array so as to be capable of performing a burnishing operation upon a workpiece gear, wherein each one of the three burnishing gear assemblies comprising said trio of burnishing gear assemblies is characterized by a different operating pressure angle, with a first one of said burnishing gear assemblies having an operating pressure angle which is greater than the generated pressure angle of the workpiece gear, a second one of said burnishing gear assemblies having an operating pressure angle which is less than the generated pressure angle of the workpiece gear, and a third one of said burnishing gear assemblies having an operating pressure angle which is substantially equal to the generated pressure angle of the workpiece gear; and wherein each one of said first and second burnishing gear assemblies, respectively having an operating pressure angle which is greater than the generated pressure angle of the workpiece gear and an operating pressure angle which is less than the generated pressure angle of the workpiece gear, comprises a hub portion defined around an axis; a burnishing gear being integrally formed upon said hub portion, having first and second axially separated sides, and having a plurality of burnishing gear teeth, having root and crest portions, extending substantially radially outwardly from said hub portion and circumferentially spaced with respect to each other around said axis; and a plurality of gashes, circumferentially spaced with respect to each other and respectively extending between said first and second axially separated sides in a non-circumferential manner, such that each one of said burnishing gear teeth of said burnishing gear has at least one gash formed therein so as to extend substantially across the entire lateral extent of said each one of said burnishing gear teeth, as well as substantially from said root portion to said crest portion of said each one of said burnishing gear teeth, so as to define at least one shearing edge portion upon said each one of said burnishing gear teeth for removing irregularities from a workpiece gear when said burnishing gear is operatively engaged with the workpiece gear during a gear burnishing operation.

3. A burnishing gear system, comprising:

a trio of burnishing gear assemblies arranged substantially within a triangular array so as to be capable of performing a burnishing operation upon a workpiece gear, wherein each one of the three burnishing gear assemblies comprising said trio of burnishing gear assemblies is characterized by a different operating pressure angle, with a first one of said burnishing gear assemblies having an operating pressure angle which is greater than the generated pressure angle of the workpiece gear, a second one of said burnishing gear assemblies having an operating pressure angle which is less than the generated pressure angle of the workpiece gear, and a third one of said burnishing gear assemblies having an operating pressure angle which is substantially equal to the generated pressure angle of the workpiece gear;

means for reciprocating the workpiece gear as said first, second, and third ones of said burnishing gear assemblies is engaged with the workpiece during a workpiece gear burnishing operation; and wherein each one of said first and second burnishing gear assemblies, respectively having an operating pressure angle which is greater than the generated pressure angle of the workpiece gear and an operating pressure angle which is less than the generated pressure angle of the workpiece gear, comprises a hub portion defined around an axis; a burnishing gear being integrally formed upon said hub portion, having first and second axially separated sides, and having a plurality of burnishing gear teeth, having root and crest portions, extending substantially radially outwardly from said hub portion and circumferentially spaced with respect to each other around said axis; and a plurality of gashes, circumferentially spaced with respect to each other and respectively extending between said first and second axially separated side in a non-cir-cumferential manner, such that each one of said burnishing gear teeth of said burnishing gear has at least one gash formed therein so as to extend substantially across the entire lateral extent of said each one of said burnishing gear teeth, as well as substantially from said root portion to said crest portion of said each one of said burnishing gear teeth, so as to define at least one shearing edge portion upon said each one of said burnishing gear teeth for removing irregularities from a workpiece gear when said burnishing gear is operatively engaged with the workpiece gear during a gear burnishing operation.

4. The burnishing gear assembly as set forth in claim 1, wherein:

said burnishing gear is provided with a plurality of gashes throughout the circumferential extent of said burnishing gear.

5. The burnishing gear assembly as set forth in claim 4, wherein:

said plurality of gashes provided upon said burnishing gear are disposed at a pitch with respect to each other, and as defined along said circumferential of said burnishing gear around said axis, of approximately 1.00 inch.

6. The burnishing gear assembly as set forth in claim 4, wherein:

each one of said plurality of gashes defined within each one of said burnishing gear teeth is disposed at a predetermined angle with respect to a transverse plane disposed through said each one of said burnishing gear teeth.

7. The burnishing gear assembly as set forth in claim 6, wherein:

said predetermined angle at which each one of said plurality of gashes is disposed is within the range of 45°–60°.

8. The burnishing gear assembly as set forth in claim 4, wherein:

each one of said plurality of gashes has a width dimension of approximately 0.050 inches.

9. The burnishing gear system as set forth in claim 2, wherein:

each one of said burnishing gears of said first and second burnishing gear assemblies is provided with a plurality of gashes throughout the circumferential extent of said burnishing gear.

10. The burnishing gear system as set forth in claim 9, wherein:

said plurality of gashes provided upon said burnishing gears of said first and second burnishing gear assemblies are disposed at a pitch with respect to each other, and as defined along said circumferential of said burnishing gear around said axis, of approximately 1.00 inch.

11. The burnishing gear system as set forth in claim 9, wherein:

each one of said plurality of gashes defined within each one of said burnishing gear teeth is disposed at a predetermined angle with respect to a transverse plane disposed through said each one of said burnishing gear teeth.

12. The burnishing gear assembly as set forth in claim 11, wherein:

said predetermined angle at which each one of said plurality of gashes is disposed is within the range of 45°–60°.

13. The burnishing gear system as set forth in claim 9, wherein:

each one of said plurality of gashes has a width dimension of approximately 0.050 inches.

14. The burnishing gear system as set forth in claim 3, wherein:

each one of said burnishing gears of said first and second burnishing gear assemblies is provided with a plurality of gashes throughout the circumferential extent of said burnishing gear.

15. The burnishing gear system as set forth in claim 14, wherein:

said plurality of gashes provided upon said burnishing gears of said first and second burnishing gear assemblies are disposed at a pitch with respect to each other, and as defined along said circumferential of said burnishing gear around said axis, of approximately 1.00 inch.

16. The burnishing gear system as set forth in claim 14, wherein:

each one of said plurality of gashes defined within each one of said burnishing gear teeth is disposed at a predetermined angle with respect to a transverse plane disposed through said each one of said burnishing gear teeth.

17. The burnishing gear assembly as set forth in claim 16, wherein:

said predetermined angle at which each one of said plurality of gashes is disposed is within the range of 45°–60°.

18. The burnishing gear system as set forth in claim 14, wherein:

each one of said plurality of gashes has a width dimension of approximately 0.050 inches.

19. The burnishing gear assembly as set forth in claim 1, wherein:

said at least one gash defines a gap which effectively separates each one of said burnishing gear teeth into longitudinally spaced tooth sections as considered along the longitudinal extent of each one of said burnishing gear teeth which extends from said first axial side of said burnishing gear to said second axial side of said burnishing gear.

20. The burnishing gear system as set forth in claim 2, wherein:

said at least one gash defines a gap which effectively separates each one of said burnishing gear teeth into longitudinally spaced tooth sections as considered along the longitudinal extent of each one of said burnishing gear teeth which extends from said first axial side of said burnishing gear to said second axial side of said burnishing gear.

21. The burnishing gear system as set forth in claim 3, wherein:

said at least one gash defines a gap which effectively separates each one of said burnishing gear teeth into longitudinally spaced tooth sections as considered along the longitudinal extent of each one of said burnishing gear teeth which extends from said first axial side of said burnishing gear to said second axial side of said burnishing gear.

* * * * *